US008337106B2

(12) United States Patent
Komatsu et al.

(10) Patent No.: US 8,337,106 B2
(45) Date of Patent: Dec. 25, 2012

(54) IMAGE FORMING APPARATUS WITH IMAGE FORMING SECTION MOVEABLY SUPPORTED BY RECORDING MEDIUM CONVEYING SECTION

(75) Inventors: Shin Komatsu, Kanagawa (JP); Masanori Seto, Kanagawa (JP); Yasuhide Saito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 346 days.

(21) Appl. No.: 12/880,854

(22) Filed: Sep. 13, 2010

(65) Prior Publication Data

US 2011/0236097 A1 Sep. 29, 2011

(30) Foreign Application Priority Data

Mar. 26, 2010 (JP) ..... 2010-073719

(51) Int. Cl.
*G03G 15/00* (2006.01)
*G03G 21/16* (2006.01)

(52) U.S. Cl. ..... 400/691; 400/693; 399/111

(58) Field of Classification Search ..... 399/116, 399/111, 112, 119, 167, 223, 228; 400/691, 400/693
See application file for complete search history.

(56) References Cited

U.S. PATENT DOCUMENTS

| | | | | |
|---|---|---|---|---|
| 6,571,073 | B1 * | 5/2003 | Suzuki et al. | 399/116 |
| 7,912,418 | B2 * | 3/2011 | Hattori et al. | 399/405 |
| 2002/0064393 | A1 | 5/2002 | Akimoto | |
| 2005/0264645 | A1 * | 12/2005 | Seto et al. | 347/243 |
| 2006/0257163 | A1 * | 11/2006 | Sato | 399/111 |
| 2009/0317130 | A1 * | 12/2009 | Ishikawa et al. | 399/116 |
| 2010/0247142 | A1 * | 9/2010 | Kikuchi et al. | 399/112 |
| 2011/0026968 | A1 * | 2/2011 | Ishii et al. | 399/111 |

FOREIGN PATENT DOCUMENTS

| | | | |
|---|---|---|---|
| JP | 2001-290322 | A | 10/2001 |
| JP | 2002-77486 | A | 3/2002 |
| JP | 2006-84780 | A | 3/2006 |
| JP | 2011237641 | A * | 11/2011 |

* cited by examiner

*Primary Examiner* — Daniel J Colilla
(74) *Attorney, Agent, or Firm* — Sughrue Mion, PLLC

(57) ABSTRACT

The present invention provides an image forming apparatus including: a recording medium conveying section; an image forming section, disposed to the recording medium conveying section and relatively moveably supported by the recording medium conveying section at one end side, that forms an image on a recording medium; a side panel that configures a side face portion of the image forming section in a width direction intersecting with the conveying direction, and supports a drive source that drives the image forming section; a support plate, provided between the recording medium conveying section and the image forming section to cover the bottom side of the image forming section, and is supported at a support portion provided at the other end side of the recording medium conveying section; and a resilient member that resiliently supports the support plate and the side panel.

6 Claims, 11 Drawing Sheets

IMAGE FORMING APPARATUS WITH IMAGE FORMING SECTION MOVEABLY SUPPORTED BY RECORDING MEDIUM CONVEYING SECTION

CROSS-REFERENCE TO RELATED APPLICATION

This application is based on and claims priority under 35 USC 119 from Japanese Patent Application No. 2010-073719 filed Mar. 26, 2010.

BACKGROUND

1. Technical Field

The present invention relates to an image forming apparatus.

2. Related Art

A conventional frame connection structure for an image forming apparatus has been proposed. For example, the conventional frame connection structure may be provided with separate bodies of a body lower frame provided at a lower portion of the apparatus body for making contact with an installation surface, and a sub-frame that supports an image holding body and a writing section that need positioning. Further, the conventional frame connection structure may have three point connections between the body lower frame and the sub-frame, and therefore may be structured so that the unevenness of the installation surface may not be readily transmitted to the sub-frame through the body lower frame.

Further, a conventional image forming apparatus has been proposed. For example, the conventional image forming apparatus may be configured such that a second apparatus body is supported at three points by an upper portion of a first apparatus body. Due thereto, this conventional image forming apparatus may prevent distortion that would cause problems for the second apparatus body from occurring, by partitioning the first apparatus body into plural blocks, and supporting the second apparatus body with the plural blocks.

Furthermore, a conventional image forming apparatus has been proposed. For example, in the conventional image forming apparatus, a sub-frame for supporting an intermediate transfer member and image forming units may be resiliently supported by a main frame via resilient members. Due thereto, the sub-frame may not be affected by deformation of the main frame. Consequently, a high quality of image can be obtained with this conventional image forming apparatus.

SUMMARY

According to a first aspect of the present invention, there is provided an image forming apparatus including: a recording medium conveying section that conveys a recording medium; an image forming section, disposed to the recording medium conveying section and relatively moveably supported by the recording medium conveying section at one end side, that forms an image on the recording medium; a side panel that configures a side face portion of the image forming section in a width direction intersecting with the conveying direction of the recording medium, and supports a drive source that drives the image forming section; a support plate, provided between the recording medium conveying section and the image forming section to cover the bottom side of the image forming section, and is supported at a support portion provided at the other end side of the recording medium conveying section; and a resilient member that resiliently supports the support plate and the side panel.

BRIEF DESCRIPTION OF THE DRAWINGS

Exemplary embodiments of the present invention will be described in detail based on the following figures, wherein.

DETAILED DESCRIPTION

Herebelow, an example of an exemplary embodiment of the present invention will be described in detail with reference to the drawings.

In the present exemplary embodiment explained below, a direction orthogonal to the conveying direction of recording paper (recording medium) is referred to as the "width direction". Additionally, the left hand side in FIG. 1 is referred to as the "one end side" and the right hand side as the "other end side".

Figure 1:
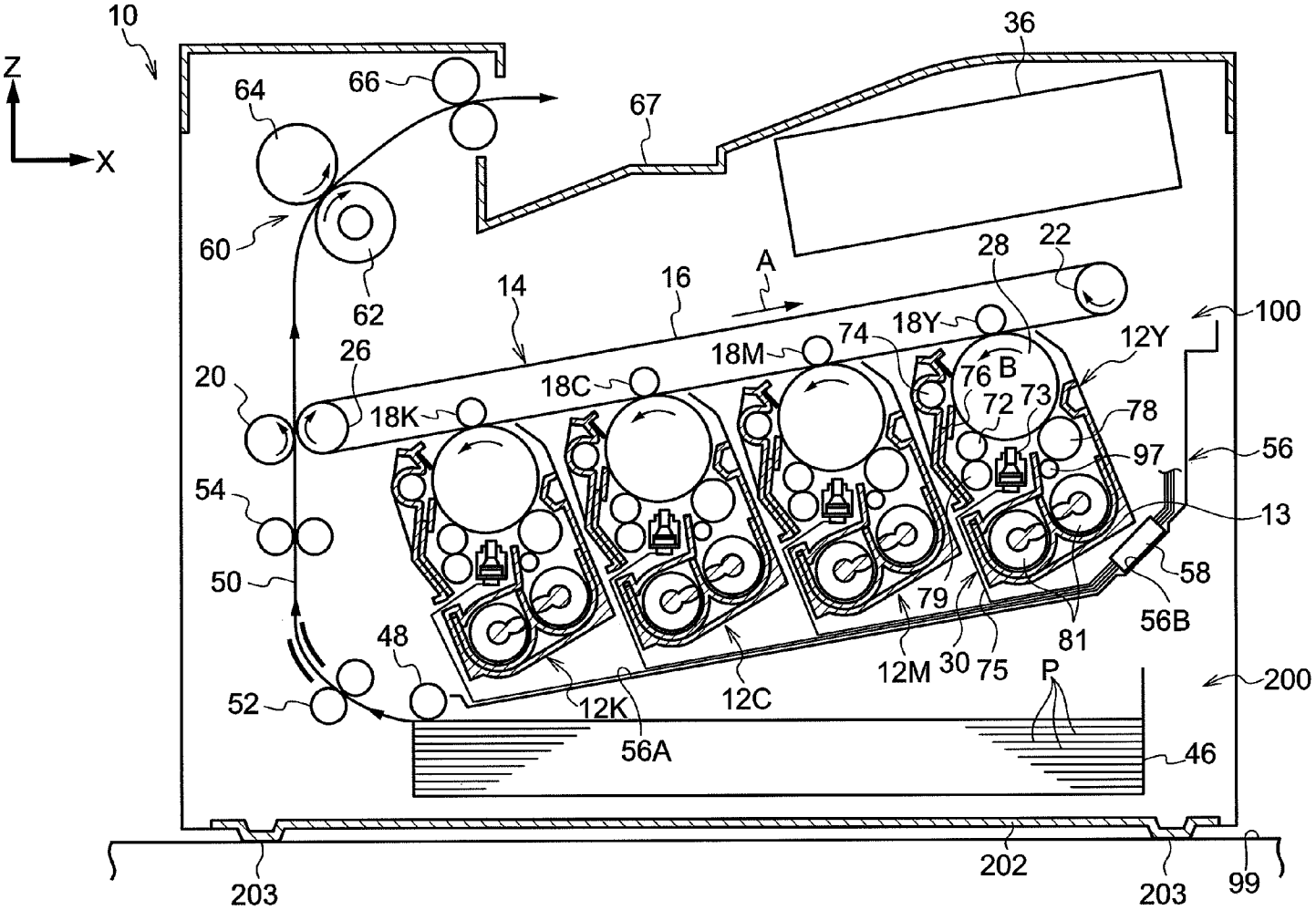
FIG. 1 is an overall view showing a schematic configuration of an image forming apparatus according to the present exemplary embodiment.

Explanation follows first regarding the overall configuration of an image forming apparatus, with reference to FIG. 1.

As shown in FIG. 1, in an image forming apparatus 10, as an example, image forming units 12Y, 12M, 12C, 12K are disposed at the center of the image forming apparatus 10 in an inclined row (in the direction towards the bottom left in FIG. 1). The image forming units 12Y, 12M, 12C, 12K are an example of an image forming section that perform image forming with four colors of toner (developing agent) of yellow (Y), magenta (M), cyan (C), black (K). The disposed sequence of the image forming units 12 is Y, M, C, K, from the top right towards the bottom left of FIG. 1.

Each of the image forming units 12Y, 12M, 12C, 12K are of a similar configuration, apart from the toner contained therein. In the following explanation, when discrimination is made between each of the colors yellow, magenta, cyan, black, the respective suffix letters Y, M, C, K are appended after reference numbers. However, when it is not required to distinguish between each of the colors in the following explanation, the respective suffix letters Y, M, C, K following the reference numbers will be omitted. There are no particularly limitations to the production methods of each of the toners Y, M, C, K.

A transfer unit 14 is provided above the image forming units 12 for transferring toner images (images) formed on each of the image forming units 12 onto recording paper P. The transfer unit 14 is configured including, a tube shaped intermediate transfer belt 16, four primary transfer rollers 18Y, 18M, 18C, 18K, and a secondary transfer roller 20. The four primary transfer rollers 18Y, 18M, 18C, 18K are disposed inside the intermediate transfer belt 16, and the toner images of the respective image forming units 12 are transferred and superimposed onto the intermediate transfer belt 16. The secondary transfer roller 20 causes the toner image superimposed on the intermediate transfer belt 16 to be transferred onto the recording paper P.

The intermediate transfer belt 16 is entrained around a drive roller 26, disposed opposing the secondary transfer roller 20, and a rotatably supported support roller 22. The intermediate transfer belt 16 undertakes circulatory movement in the arrow A direction (clockwise direction in FIG. 1) due to driving and rotating the drive roller 26 with a drive unit 150 (see FIG. 2), explained below.

The primary transfer rollers 18Y, 18M, 18C, 18K are disposed facing a photoreceptor 28 of each of the respective image forming units 12Y, 12M, 12C, 12K, with the intermediate transfer belt 16 nipped therebetween. Note that the photoreceptor 28 is an example of an exposed body. A transfer voltage having an opposite polarity (positive polarity as an example in the present exemplary embodiment) to the toner polarity is applied to the primary transfer rollers 18Y, 18M, 18C, 18K. A transfer voltage having opposite polarity to the toner polarity is also applied to the secondary transfer roller 20. A cleaning device (not shown in the figures) is provided at the outer peripheral face of the intermediate transfer belt 16 at a position where the support roller 22 is provided. The cleaning device removes remaining toner, paper dust and the like, from the intermediate transfer belt 16.

A paper supply section 46 that houses the recording paper P is provided below the image forming units 12. A paper conveying path 50 along which the recording paper P is conveyed is provided extending upwards in a vertical direction (arrow Z direction) from an end portion of the paper supply section 46 (a right hand end portion in FIG. 1).

A feed roller 48, conveying rollers 52, and position alignment rollers 54 are provided along the paper conveying path 50. The feed roller 48 feeds the recording paper P out from the one end side of the paper supply section 46. The conveying rollers 52 are configured by a pair of rollers for conveying the recording paper P. The position alignment rollers 54, for matching the conveying timing of the recording paper P to the movement timing of the image on the intermediate transfer belt 16, are configured from a pair of rolls.

The recording paper P is fed out in succession from the paper supply section 46 by the feed roller 48, and is conveyed via the paper conveying path 50 to a secondary transfer position of the intermediate transfer belt 16 by the position alignment rollers 54.

A fixing unit 60 is provided on the paper conveying path 50 at the downstream side of (above) the secondary transfer roller 20. The fixing unit 60 includes a heating roller 62 heated by a heat source (not shown in the figures, for example a halogen heater), and a press roller 64 that moves in concert with the heating roller 62, nipping the recording paper P and applying pressure to the toner image. Discharge rollers 66 are also provided on the paper conveying path 50, at the downstream side of the fixing unit 60, the discharge rollers 66 configured from a pair of rollers that discharge the recording paper P after fixing. The recording paper P that has been discharged by the discharge rollers 66 is discharged into a discharge section 67 formed on the top face of the image forming apparatus 10. A controller 36 is provided at the opposite side of the image forming apparatus 10 to that of the paper conveying path 50. The controller 36 performs control on each section of the image forming apparatus 10.

Leg portions 203 are provided at four corner sections of a bottom panel 202 of a recording medium conveying section 200 that configures a bottom portion of the image forming apparatus 10. The image forming apparatus 10 of the present exemplary embodiment is installed by placing the leg portions 203 of the bottom panel 202 on an installation surface 99, such as, for example, a table, the floor, or the like. Note that in the present exemplary embodiment, the leg portions 203 are formed as downward facing projections by making indentations in the top face at four corner sections of the bottom panel 202.

Next, explanation follows regarding each of the image forming units 12Y, 12M, 12C, 12K for each of the colors. Explanation here is without discrimination by color of toner.

The image forming unit 12 includes the photoreceptor 28, a charging roller 72, an exposure unit 73, a developing roller 78, a charge removing lamp 74, and a cleaning blade 76. The photoreceptor 28 is rotationally driven in the arrow B direction (clockwise direction in FIG. 1). The charging roller 72 contacts the outer peripheral face of the photoreceptor 28 and charges the photoreceptor 28. The exposure unit 73 is an example of an exposing section that illuminates exposure light onto the outer peripheral face of the photoreceptor 28 and forms an electrostatic latent image thereon. The developing roller 78 develops the electrostatic latent image on the outer peripheral face of the photoreceptor 28 with toner. The charge removing lamp 74 illuminates light onto the outer peripheral face of the photoreceptor 28 after transfer, removing charge. The cleaning blade 76 cleans the outer peripheral face of the photoreceptor 28 after charge removal.

The charging roller 72, the exposure unit 73, the developing roller 78, the charge removing lamp 74 and the cleaning blade 76 are disposed facing the outer peripheral face of the photoreceptor 28 in this sequence, from the photoreceptor 28 rotational direction upstream side to the downstream side. A cleaning roller 79 is rotatably provided at the opposite side of the outer peripheral face of the charging roller 72 to that of the photoreceptor 28, for removing, for example, external additives and the like, of the toner that have adhered to the outer peripheral face of the charging roller 72. The charging roller 72 is connected to a power distribution section (not shown in the figures). During image forming, the charging roller 72 is powered and, while undertaking following rotation, charges the outer peripheral face of the photoreceptor 28.

Two helical shaped conveying members 81 are provided at the downstream side of the developing roller 78 for stirring (mixing) developing agent (for example, a composite of a resin toner and a metal carrier) supplied from a toner supply section (not shown in the figures), and supplying the developing agent to the developing roller 78. A thin-layer forming roller 97 is also provided at the downstream side of the developing roller 78, facing the outer peripheral face of the developing roller 78. The thin-layer forming roller 97 is disposed further to the developing roller 78 rotation direction upstream side than the photoreceptor 28, with a separation gap between the thin-layer forming roller 97 and the outer peripheral face of the developing roller 78. The thin-layer forming roller 97 regulates the passing amount of developing agent on the outer peripheral face of the developing roller 78, thereby forming a developing agent layer (thin layer) of predetermined thickness on the developing roller 78.

The developing roller 78 is configured from a fixed magnet roller (not shown in the figures) and a cylindrical shaped developing sleeve (not shown in the figures) rotatably provided at the outside of the magnet roller. Note that during developing a voltage is applied between the developing roller 78 and the photoreceptor 28, thereby forming an electric field. While the electric field is formed, the developing roller 78 moves the toner of the developing agent towards the electrostatic latent image of the photoreceptor 28 while rotating.

Next, explanation follows regarding operation of image forming processes of the image forming apparatus 10, with reference to FIG. 1.

As shown in FIG. 1, when the image forming apparatus 10 is in the operational state, image data that has been image processed by the controller 36 is converted into coloring matter gradation data for each color, and sequentially output to exposing devices 30. In each of the exposing devices 30, the exposure unit 73 emits respective exposure light according to the coloring matter gradation data of each color, and exposure is performed of the outer peripheral face of the respective photoreceptor 28 that has been charged by the charging roller 72, and an electrostatic latent image is formed on the respective photoreceptor 28.

The electrostatic latent image formed on each of the photoreceptor 28 is developed (made visible) by the developing roller 78 as a toner image (image) in each of the respective colors yellow (Y), magenta (M), cyan (C) and black (K). Next, the toner images of each color formed on the respective photoreceptor 28 are successively transferred and superimposed on the intermediate transfer belt 16 by the four primary transfer rollers 18Y, 18M, 18C, 18K.

The toner images of each color that have been superimposed and transferred onto the intermediate transfer belt 16 are then secondary transferred by the secondary transfer roller 20 onto the recording paper P conveyed from the paper supply section 46. The secondary transfer roller 20 is provided at the one end side of an image forming section 100. The toner image of each color on the recording paper P is then fixed by the heating roller 62 and the press roller 64 in the fixing unit 60. The recording paper P is then, after fixing, discharged into the discharge section 67 by the discharge rollers 66. After primary transfer of the toner images is completed, remaining toner, paper dust and the like on outer peripheral face of the photoreceptor 28 is removed by the cleaning blade 76.

Figure 2:
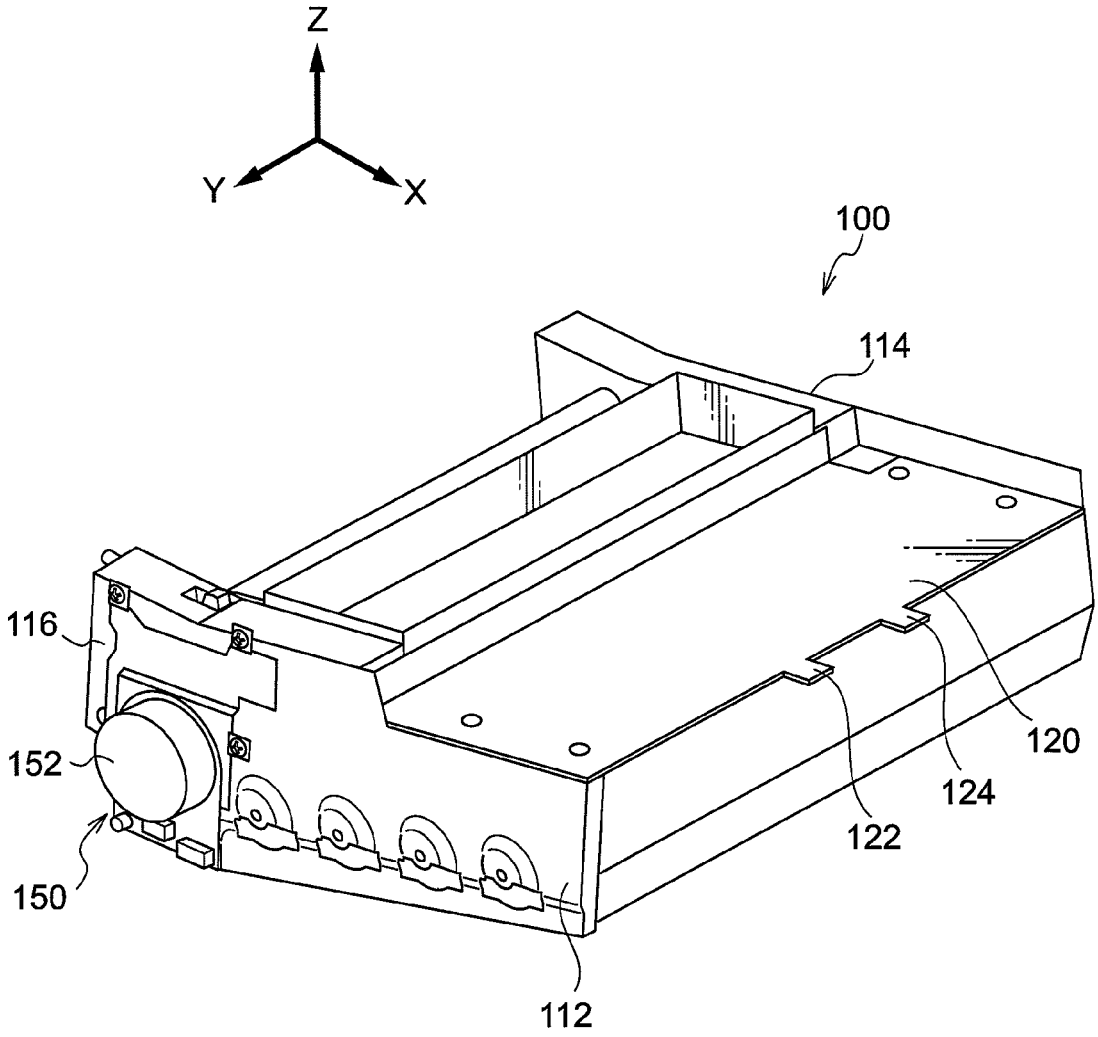
FIG. 2 is a perspective view schematically showing an image forming section according to the present exemplary embodiment.
Figure 3:
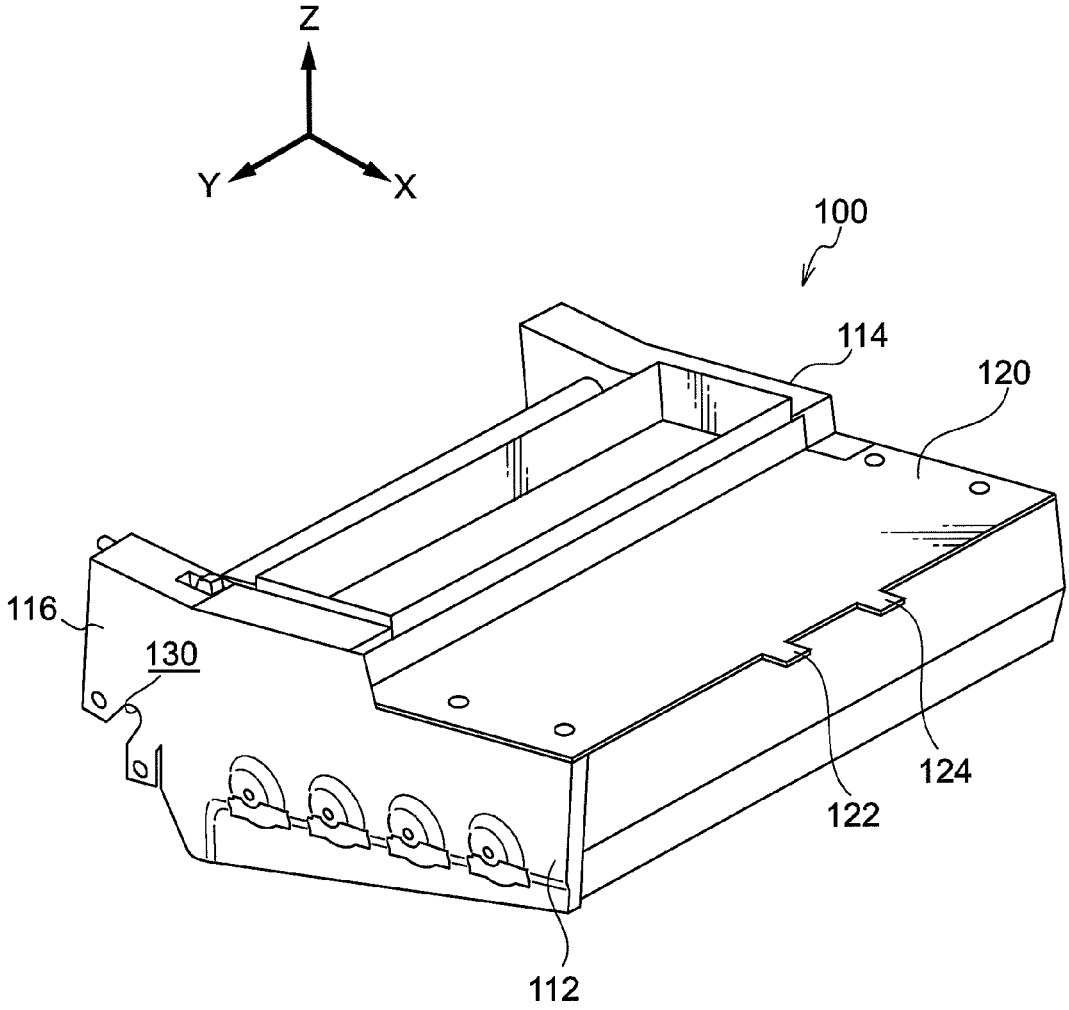
FIG. 3 is a perspective view corresponding to FIG. 2, showing the image forming section in a state in which the drive unit is not provided.

Next, explanation follows regarding the image forming section, with reference to FIG. 2 and FIG. 3.

As shown in FIG. 2 and FIG. 3, the image forming section 100 includes plate shaped metal side panels 112, 114 disposed at the right hand side and left hand side, respectively, when viewed along the arrow X direction. Namely, the side panel 112 and the side panel 114 are configured at width direction side face portions of the image forming section 100.

Each of the image forming units 12 (see FIG. 1) and the transfer unit 14 are disposed between the side panel 112 and the side panel 114. The image forming section 100 is unitized by supporting each member configuring the image forming units 12 and the transfer unit 14 (for example, the photoreceptors 28) by the side panel 112 and the side panel 114.

The drive unit 150 is also fixed to the side panel 112, as shown in FIG. 2. The drive unit 150 includes a drive motor 152 that is a drive source for driving the photoreceptor 28, the developing roller 78, and the like. Note that, the drive motor 152 is an example of a drive source. A drive transmission system (not shown in the figures) is housed in the drive unit 150. The drive transmission system includes, for example, plural gears for transferring driving force of the drive motor 152 to the photoreceptor 28 and the like, a clutch for controlling transmission and disengaging, and the like.

As shown in FIG. 3, a supported section 116 is formed at one end portion of the side panel 112. A U-shaped positioning groove 130 is formed in the supported section 116, extending upwards at an angle from the one end side towards the other end side.

Note that, while not shown in FIG. 3, one end portion of the side panel 114 is configured with a supported section 116 and positioning groove 130 formed therein, in a similar manner to the side panel 112.

In the present exemplary embodiment, the exposure unit 73 and the photoreceptor 28 are grounded (connected to earth) at the side panels 112, 114.

Furthermore, as shown in FIG. 2 and FIG. 3, positioning tabs 122, 124 are formed projecting out towards the other end side at the other end portion of a top panel 120 configuring a top portion at the other end side of the image forming section 100.

Figure 4:
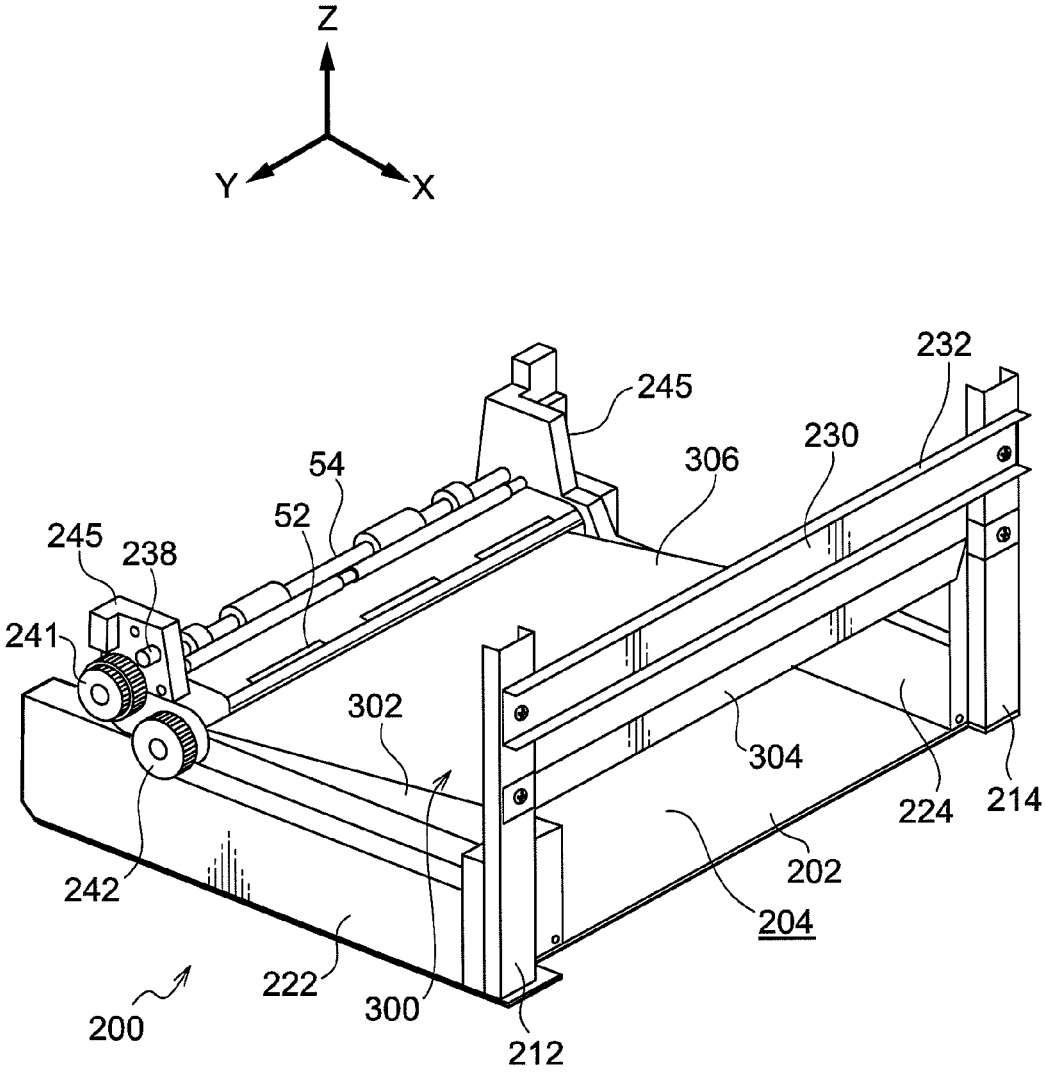
FIG. 4 is a perspective view schematically showing a recording medium conveying section according to the present exemplary embodiment.
Figure 5:
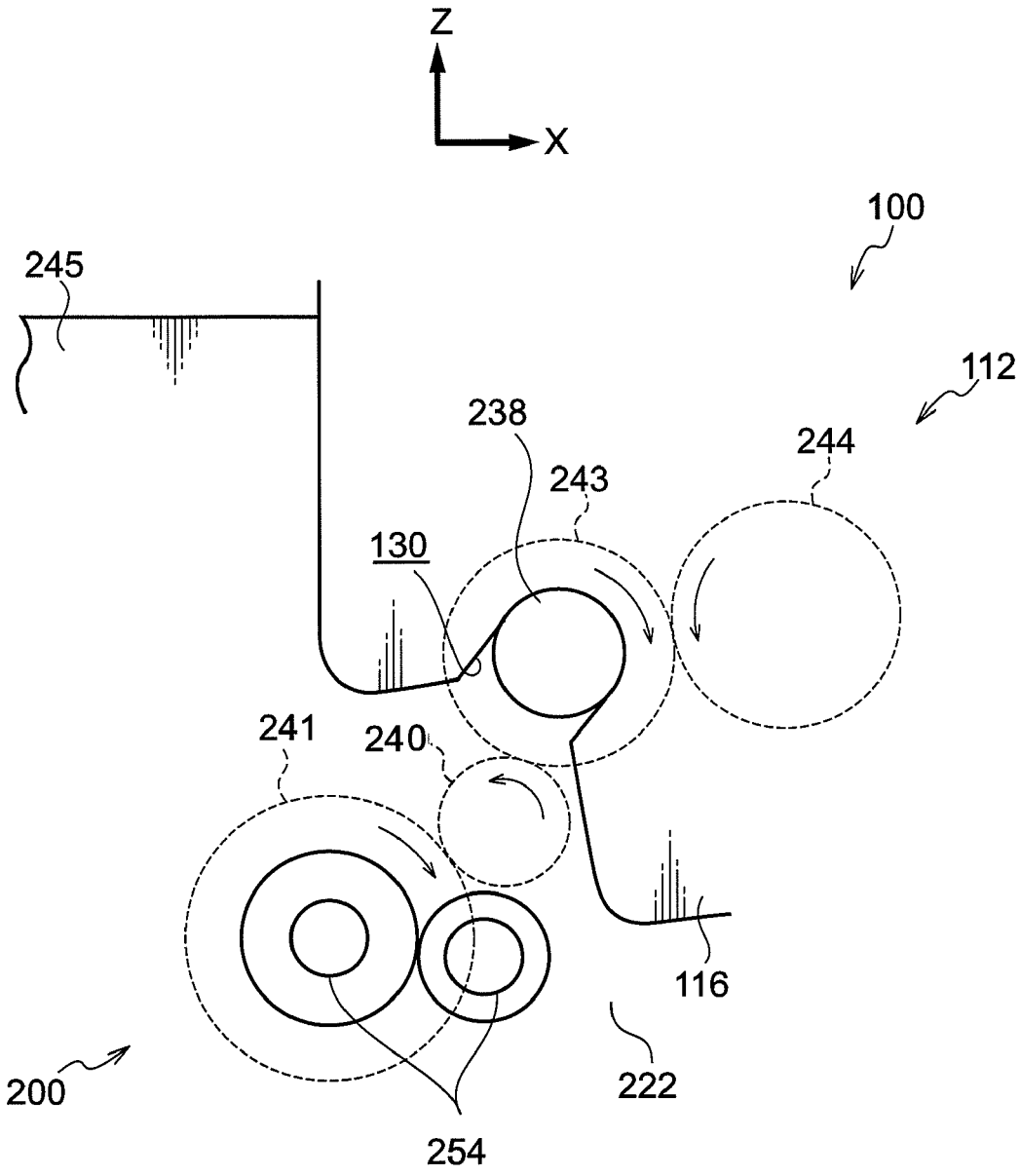
FIG. 5 is a side view schematically showing a positioning shaft and a drive system of an image forming apparatus.

Next, explanation follows regarding the recording medium conveying section 200, with reference to FIG. 1, FIG. 4, and FIG. 5.

As shown in FIG. 1, the recording medium conveying section 200 configures a bottom portion of the image forming apparatus 10. The bottom panel 202, configuring the bottom face of the recording medium conveying section 200, configures the bottom face of the image forming apparatus 10. The leg portions 203 are provided at the four corner sections of the bottom panel 202. The image forming apparatus 10 is installed with the leg portion 203 on an installation surface 99, such as, for example, a table, floor or the like.

As shown in FIG. 4, support pillar portions 212, 214 are provided extending upwards at both width direction (arrow Y direction) end portions at other end portions of the bottom panel 202. Side walls 222, 224 are provided at both width direction side portions of the bottom panel 202. The side walls 222, 224 configure the two side walls of a space 204 in which the paper supply section 46 is accommodated. Further, the support pillar portions 212, 214 are connected to the other end portions of the side walls 222, 224.

A horizontal guide member 230 is fastened to top end portions at the face on the other end portion side of the support pillar portions 212, 214, to connect the support pillar portions 212, 214 together.

A support plate 300 constructed from a metal plate is provided above the space 204 over the bottom panel 202. The support plate 300 is provided to cover the space 204 in plan view. Side faces 302 are formed folding around downwards at the two width direction side portions of the support plate 300 (see FIG. 8). The side walls 222, 224 are fastened to the side faces 302. A vertical face 304 is formed folding around upwards at the other end portion of the support plate 300 (see FIG. 8). The vertical face 304 is fastened to the support pillar portions 212, 214, on the face on the other end portion side thereof below the horizontal guide member 230. Accordingly, the other end portion of the support plate 300 is thereby supported by the support pillar portions 212, 214.

In the present exemplary embodiment, a top face 306 is disposed covering the space 204 of the support plate 300, to incline upwards towards the other end side.

Support bearings 245 are provided to support the supported section 116 at both width direction (Y direction) end portions of the other end portion of the side walls 222, 224. Positioning shafts 238 are provided protruding towards the width direction outside (Y direction outside) at the support bearings 245. Namely, the positioning shafts 238 protrude out (are disposed) along a direction orthogonal to the conveying direction of the recording paper P.

Note that, while not shown in FIG. 4, one of the positioning shafts 238 also protrudes, in a similar manner, towards the width direction outside from the support bearings 245 on the opposite side.

The position alignment rollers 54 (see FIG. 1) are supported by the support bearings 245. A gear 241 installed with a clutch is provided at an axial end portion of one of the position alignment rollers 54.

The conveying rollers 52 (see FIG. 1) are supported diagonally below at the other end side of the position alignment rollers 54. A gear 242 is provided to an axial end portion of one of the conveying rollers 52.

As shown in FIG. 5, drive force is transmitted from the drive motor 152 (see FIG. 2) of the drive unit 150. A gear 244 intermeshes with an intermediate gear 243 rotatably supported on the positioning shafts 238. The intermediate gear 243 intermeshes with an intermediate gear 240 rotatably supported by the recording medium conveying section 200. The intermediate gear 240 intermeshes with a gear 241 of an axial end portion of the position alignment roller 54. Accordingly, the drive force is transmitted to the gear 244 by driving the drive motor 152 (see FIG. 2), and further transmitted to the gear 241 via the intermediate gear 243 and the intermediate gear 240.

The drive force of the drive motor 152 is configured to also drive the gear 242 at the axial end portion of the conveying roller 52 via plural gears (not shown in the figures) from the gear 241.

Next, explanation follows of assembly of the image forming section 100 to the recording medium conveying section 200, with reference to FIG. 5 to FIG. 9.

Figure 7:
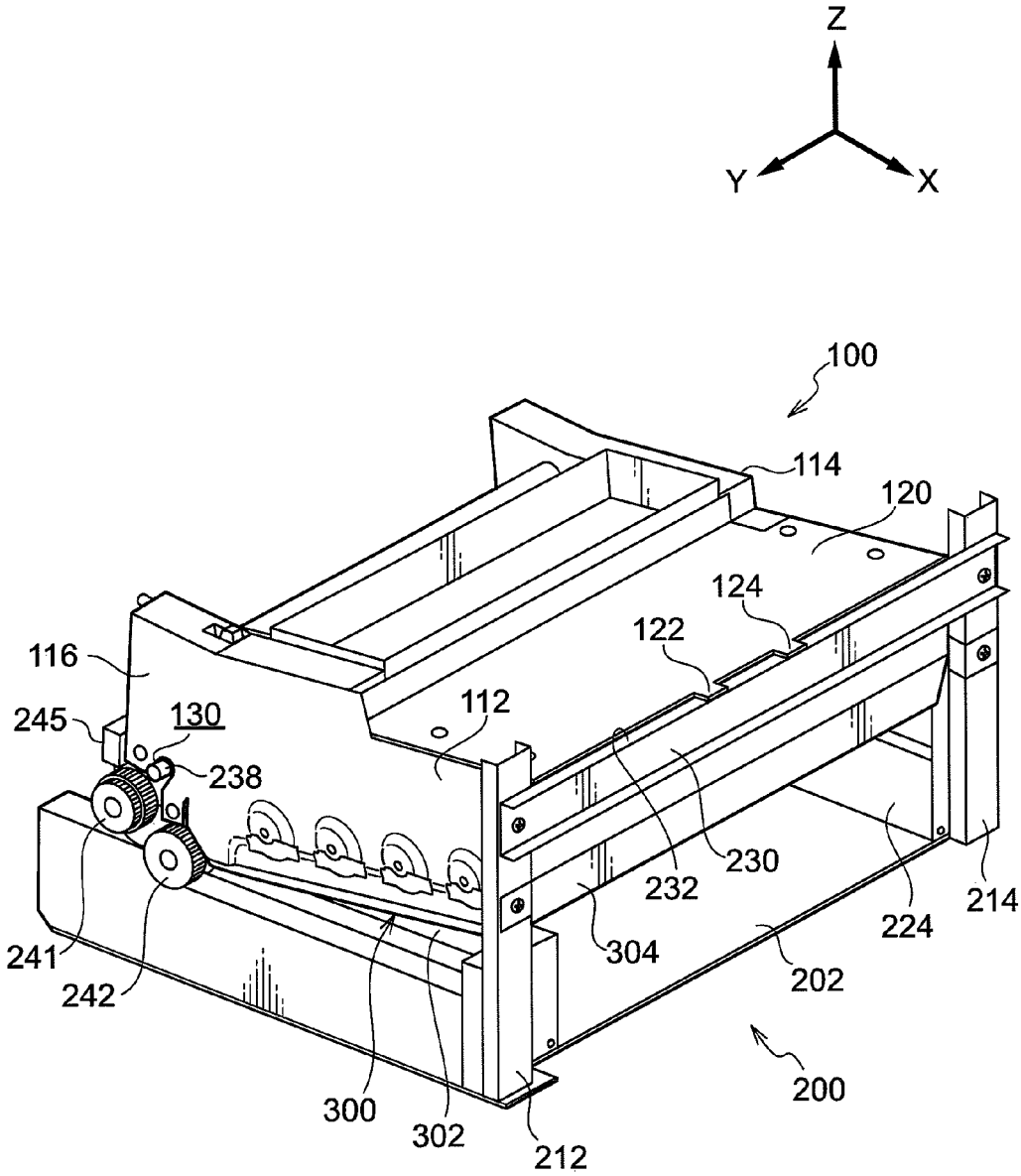
FIG. 7 is a perspective view corresponding to FIG. 6 showing the image forming section in a state in which the drive unit is not provided.

As shown in FIG. 5 and FIG. 7, the image forming section 100 and the recording medium conveying section 200 are positioned by the positioning shafts 238 (of the support bearings 245 at the one end portion of the recording medium conveying section 200) fitting into the positioning groove 130 (formed to the supported section 116 at one end portion of the image forming section 100). The image forming section 100 is also rotatably supported with the positioning shafts 238 at the center of rotation.

Figure 6:
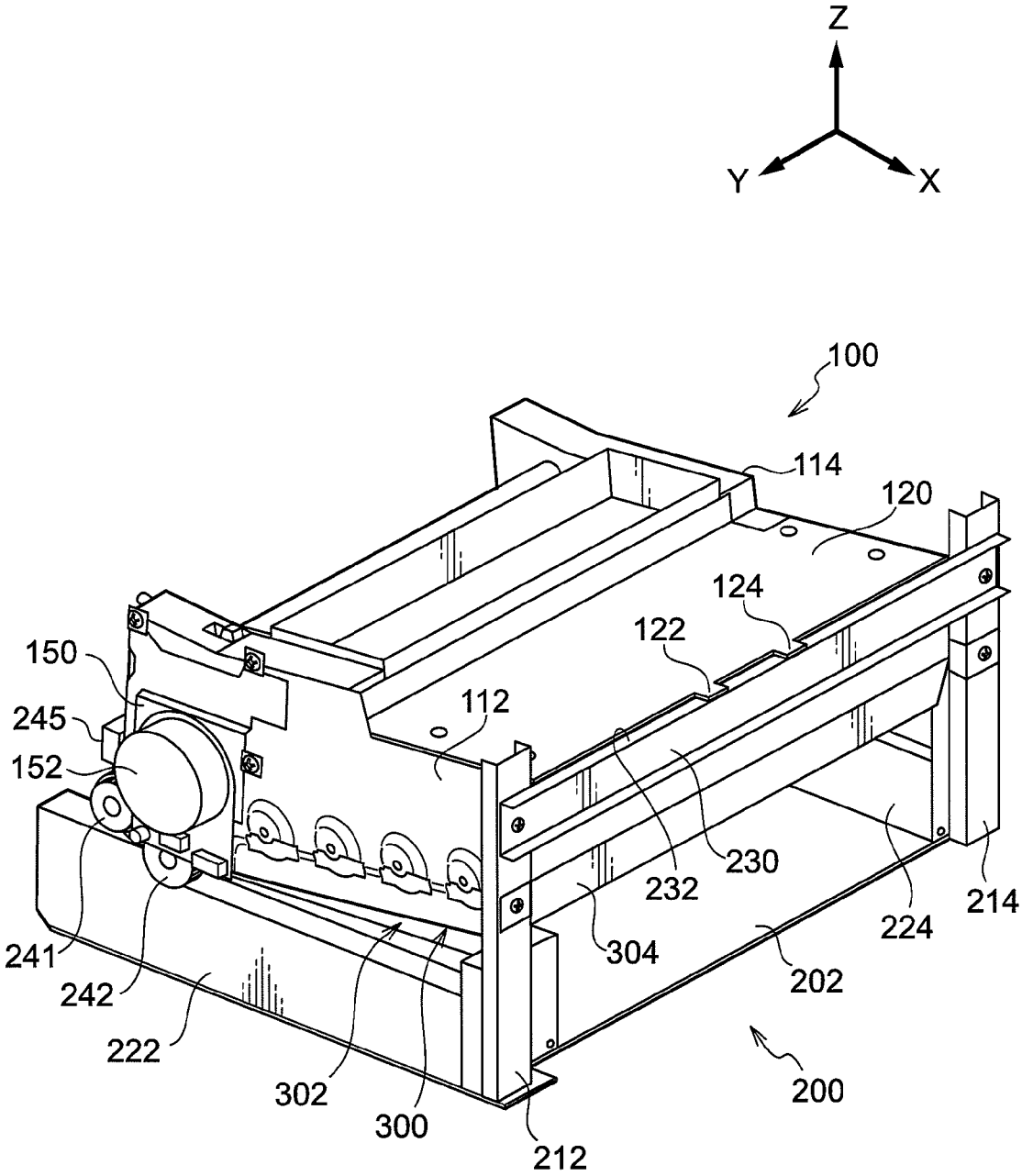
FIG. 6 is a perspective view schematically showing an assembled state of an image forming section and a recording medium conveying section, according to the present exemplary embodiment.

Then, as shown in FIG. 6 and FIG. 7, the other end portion of the image forming section 100 is positioned by making the positioning tabs 122, 124 (formed to a top portion at the other end portion of the image forming section 100) contact (rest on) a positioning face 232 configuring the top face of the horizontal guide member 230 (fastened to the support pillar portions 212, 214 at the other end portion of the recording medium conveying section 200).

Figure 8:
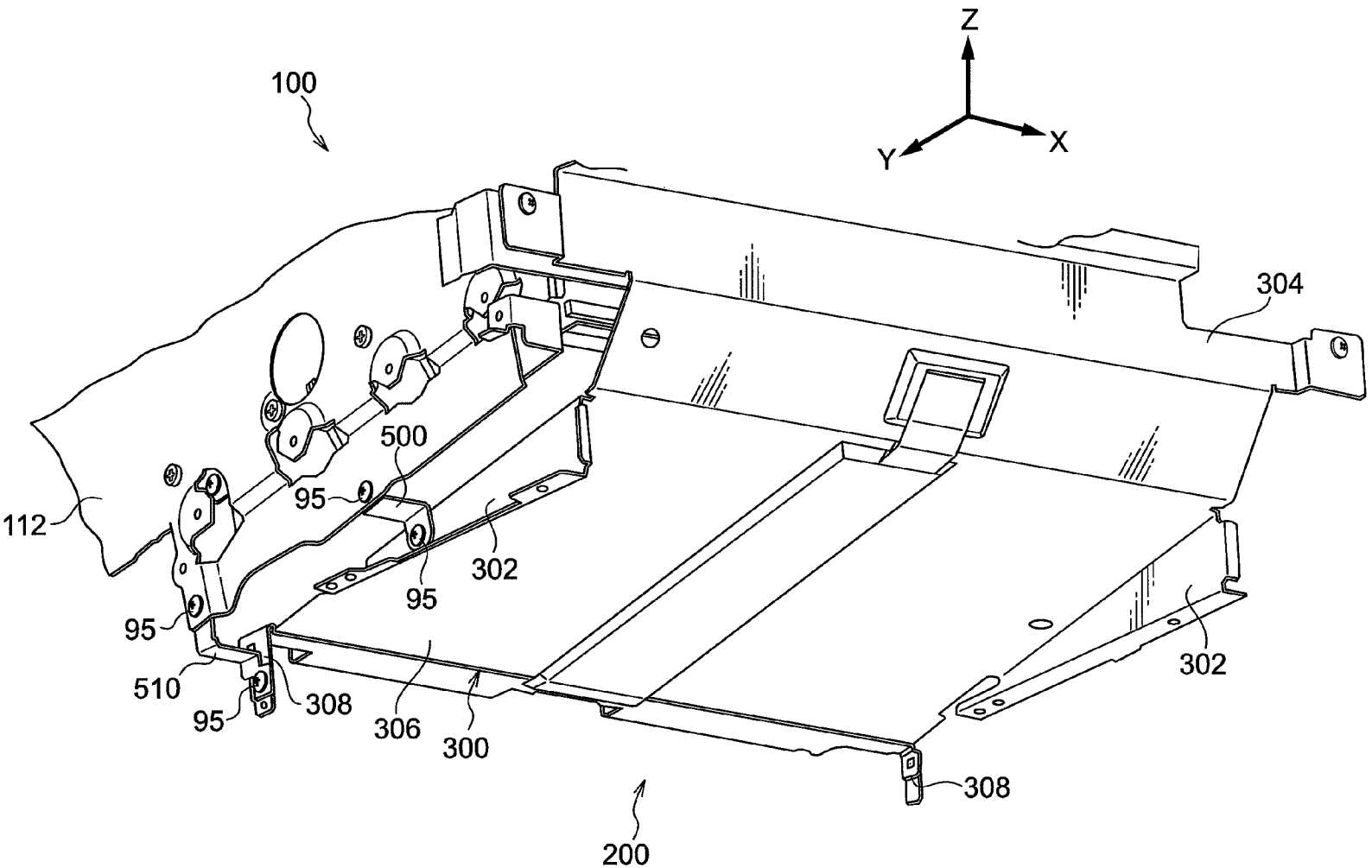
FIG. 8 is a perspective view seen from obliquely below an assembled state a recording medium conveying section and an image forming section in a state in which the drive unit is not provided.
Figure 9:
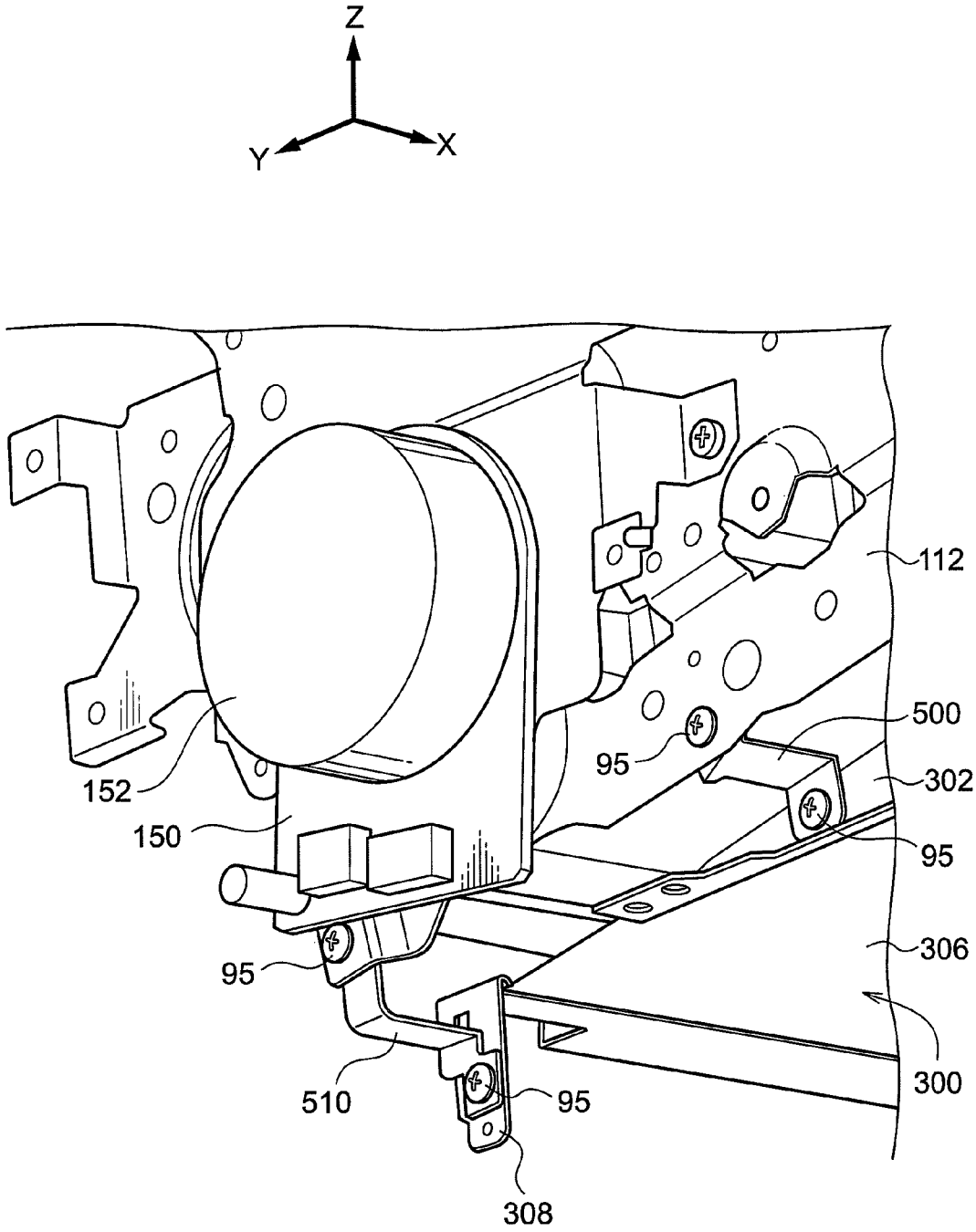
FIG. 9 is an enlarged perspective view seen from obliquely below an assembled state of a recording medium conveying section and an image forming section according to the present exemplary embodiment.

Note that, as shown in FIG. 6 and FIG. 8, when the image forming section 100 has been assembled to the recording medium conveying section 200, the support plate 300 is provided between the recording medium conveying section 200 and the image forming section 100 when viewed from the side (viewed in the Y direction). The support plate 300 is provided to cover the image forming section 100 from below when viewed from the bottom face (viewed in the Z direction).

Figure 10:
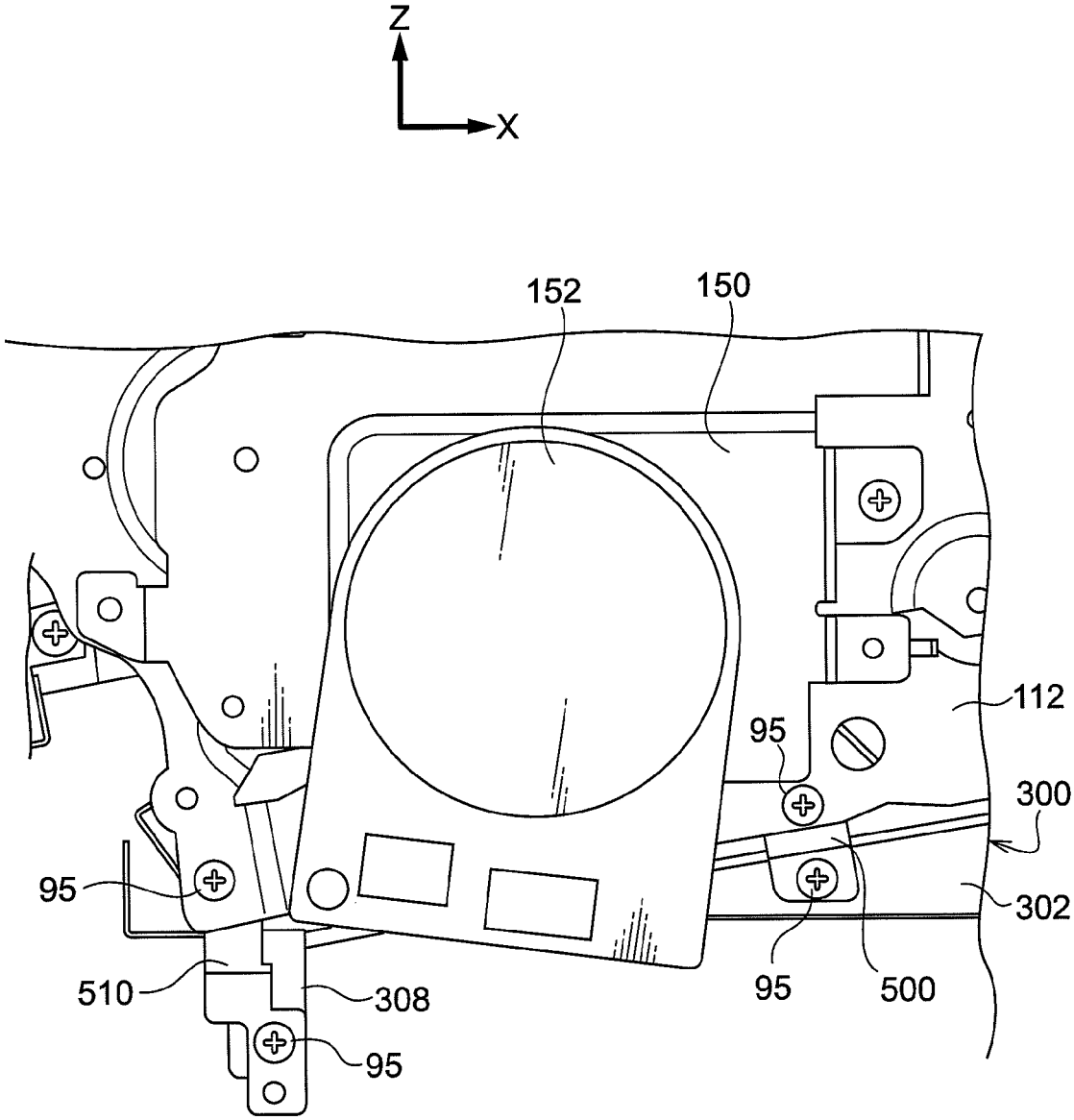
FIG. 10 is an enlarged side view showing an assembled state of the recording medium conveying section and the image forming component according to the present exemplary embodiment.

As shown in FIG. 8 and FIG. 10, the one end portion of the side panel 112 and a stay 308 (formed to the one end portion of the support plate 300 of the recording medium conveying section 200) are fastened together with a leaf spring 510. The two end portions of the leaf spring 510 are fastened by screws 95.

The side panel 112 and the side face 302 of the support plate 300 further to the other end portion side than the fastening position of the leaf spring 510 are fastened together by a leaf spring 500. Two end portions of the leaf spring 500 are also fastened by screws 95.

In the present exemplary embodiment, the leaf springs 500, 510 are configured with a metal material that is both springy and electrically conductive.

The side panel 114 and the support plate 300 are also connected at the opposite side in a similar manner using leaf springs 500, 510.

In the present exemplary embodiment, as shown in FIG. 10, the drive motor 152 is fixed to the side panel 112 above and between the leaf spring 500 and the leaf spring 510 in side view (viewed along the Y direction).

Accordingly, the one end side of the image forming section 100 is resiliently supported on the support plate 300 (the recording medium conveying section 200) by the leaf springs 500, 510.

Next, explanation follows regarding operation of the present exemplary embodiment.

Transmission of vibration from the drive motor 152 that drives the image forming section 100 to the recording medium conveying section 200 is reduced, in comparison to a structure in which the recording medium conveying section 200 is not supported through the leaf springs 500, 510 (such as, for example, a structure in which the side panels 112, 114 of the image forming section 100 and the support plate 300 of the recording medium conveying section 200 are directly fastened together with screws or the like).

The image forming section 100 of the present exemplary embodiment is rotatably supported, with the positioning shafts 238 that are provided at the one end portion of the recording medium conveying section 200, and project out (are disposed) along a direction orthogonal to the conveying direction of the recording paper P, as the axis of rotation axis. Accordingly, even though the image forming section 100 is resiliently supported with respect to the recording medium conveying section 200, the amount of relative movement between the one end side of the image forming section 100 that transfers and forms the toner image on the recording paper P and the recording medium conveying section 200 is reduced.

The metal side panels 112, 114 of the image forming section 100 and the metal support plate 300 are fastened together by the metal leaf springs 500, 510. Consequently, in the image forming section 100 of the present exemplary embodiment, the side panels 112, 114 and the support plate 300 can be made to the same electrical potential without separate provision of a member for electrical connection (such as an earth wire or the like).

Namely, the side panels 112, 114 to which the exposure unit 73 and the photoreceptor 28 are grounded, and the support plate 300 are at the same electrical potential, namely a reference potential (ground (0V)). Furthermore, the support pillar portions 212, 214 that are fastened to the support plate 300 and the bottom panel 202 and the like too are at the same electrical potential as the support plate 300. Due thereto, the frame members (case) configuring the image forming section 100 overall is at the reference potential (ground).

Furthermore, in the image forming apparatus 10 of the present exemplary embodiment, the recording medium conveying section 200 configures the bottom portion of the image forming apparatus 10, and the image forming apparatus 10 is installed by placing (the leg portions 203 of) the bottom panel 202 of the recording medium conveying section 200 on a installation surface 99 such as a desk, table or the like (see FIG. 1). Due thereto, transmission of unevenness in the installation surface 99 to the side panels 112, 114 of the image forming section 100 can be absorbed by resilient deformation of the leaf springs 500, 510.

Furthermore, as shown in FIG. 5, drive force of the drive motor 152 of the image forming section 100 is transmitted to the recording medium conveying section 200 from the one end side of the recording medium conveying section 200 on which the image forming section 100 is rotatably supported. Accordingly, the image forming apparatus 10 of the present exemplary embodiment can reduce transmission of vibration to the recording medium conveying section 200.

Note that in the present exemplary embodiment, drive force is transmitted through the intermediate gear 243 rotatably supported on the positioning shafts 238 that are at the rotational axis of the image forming section 100. Accordingly, the image forming apparatus 10 of the present exemplary embodiment can further reduce transmission of vibration to the recording medium conveying section 200.

Generally, when gears are intermeshed together and rotate, a force acts in a direction to separate the gears from each other due to the reaction force (driving reaction force) when intermeshed. Suppose that the intermediate gear 243 was supported on a different axis to the (rotational axis of the) positioning shafts 238, then reaction force (driving reaction force) due to separation and positioning of the intermediate gear 243 away from the positioning shafts 238, which are the rotational axis, would act in a direction to separate the image forming section 100 from the recording medium conveying section 200, namely the image forming section 100 would be imparted with force in a lifting direction. As a result, the image forming section 100 would distort and vibrate up and down. However, in contrast thereto, in the present exemplary embodiment, since the intermediate gear 243 is supported at the positioning shafts 238, which are the rotational axis, a configuration is achieved in which the image forming section 100 does not readily distort or vibrate up and down due to the reaction force (driving reaction force).

In the present exemplary embodiment, as shown in FIG. 10, the drive motor 152 is fixed above and between the leaf spring 500 and the leaf spring 510, in side view. However, the present invention is not limited thereto.

Figure 11:
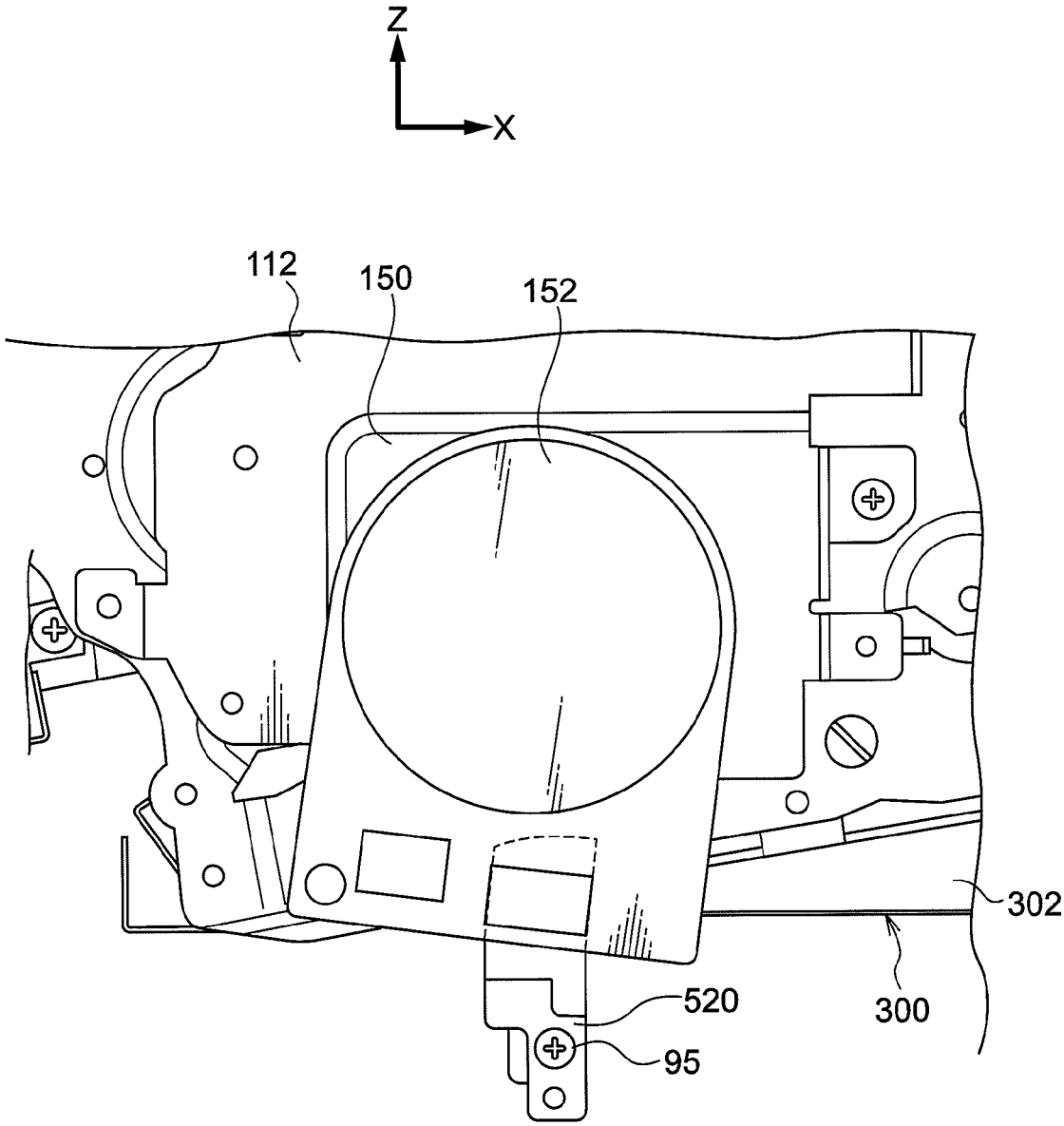
FIG. 11 is a side view corresponding to FIG. 10, showing an alternative exemplary embodiment.

For example, in an alternative exemplary embodiment shown in FIG. 11, configuration may be made with a leaf spring 520 disposed directly below, or nearly directly below; the drive motor 152.

Note that by disposing the leaf spring 520 directly below, or nearly directly below, the drive motor 152, the vibration absorbing effect can be enhanced.

The present invention is not limited to the above exemplary embodiments. Obviously various modes can be obtained without departing from the spirit of the present invention.

For example, in the above exemplary embodiment, the side panels 112, 114 of the image forming section 100 and the support plate 300 of the recording medium conveying section 200 are fastened by the four leaf springs 500, 510. However, the present invention is not limited thereto. In further alternative exemplary embodiments, configuration may be made with fastening by three or less leaf springs (resilient members), and configuration may be made with fastening by five or more leaf springs (resilient members). Configuration may be made such that, not only the one end side of the recording medium conveying section 200, but also the other end side of the recording medium conveying section 200, is resiliently supported by leaf springs, or the like.

Furthermore, for example, in the above exemplary embodiments, the side panels 112, 114 of the image forming section 100 and the support plate 300 of the recording medium conveying section 200 are fastened by the leaf springs 500, 510 or 520. However, the present invention is not limited thereto. The material, shape and the like of the resilient member(s) may be freely selected as long as the one end sides of the side panels 112, 114 of the image forming section 100 are resiliently supported by the support plate 300 of the recording medium conveying section 200.

For example, a spring of, for example, metal, synthetic resin, or the like, or an elastomer of, for example, rubber or the like, having a lower rigidity than that of the side panels 112, 114 and the support plate 300 may be employed as the resilient member(s). Note that, in cases where support is with an insulating resilient member, such as, for example, one made from rubber, synthetic resin or the like, configuration may be made with separate provision of an earth wire or the like for electrically connecting the side panels 112, 114 and the support plate 300.

Furthermore, in a configuration in which the side panels 112, 114 and the support member are configured from a resin, configuration may be made with only the resilient member being made from metal. In such cases, an earth wire or the like may be disposed at the position of contact of the side panels 112, 114 and the support plate 300 with the resilient member in order to make an electrical connection.

Furthermore, in a further alternative exemplary embodiment, the bottom panel 202 and the side walls 222, 224 may be molded in resin as a single body. In such cases, connection is not required between the bottom panel 202 and the side walls 222, 224, and a reduction in cost is possible in comparison to configurations with separate bodies.

Furthermore, for example, in the above exemplary embodiment, the drive force of the drive motor 152 was transmitted from the one end side to the recording medium conveying section 200. However, the present invention is not limited thereto. In yet another alternative exemplary embodiment, configuration may be made such that the drive force from the other end side or from a central portion is transmitted to the recording medium conveying section 200.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a recording medium conveying section that conveys a recording medium;

an image forming section, disposed to the recording medium conveying section and relatively moveably supported by the recording medium conveying section at one end side, that forms an image on the recording medium;

a side panel that configures a side face portion of the image forming section in a width direction intersecting with the conveying direction of the recording medium, and supports a drive source that drives the image forming section;

a support plate, provided between the recording medium conveying section and the image forming section to cover the bottom side of the image forming section, and is supported at a support portion provided at the other end side of the recording medium conveying section; and a resilient member that resiliently supports the support plate and the side panel.

2. The image forming apparatus of claim 1, wherein the image forming section is relatively movably supported such that the image forming section is rotatably supported with a rotation shaft provided at the one end side of the recording medium conveying section and disposed along a direction intersecting with the conveying direction of the recording medium.

3. The image forming apparatus of claim 1, wherein drive force of the drive source is transmitted to the recording medium conveying section from the one end side of the recording medium conveying section where the image forming section is relatively moveably supported, and the recording medium conveying section is driven.

4. The image forming apparatus of claim 1, wherein the resilient member is configured from a metal, and electrically connects the support plate and the side panel.

5. The image forming apparatus of claim 1, wherein the recording medium conveying section configures a bottom section of the image forming apparatus that contacts an installation surface for installing the image forming apparatus.

6. The image forming apparatus of claim 1, wherein the resilient member is disposed directly below, or nearly directly below, the drive source.

* * * * *